US005697356A

United States Patent [19]

Chappell

[11] Patent Number: 5,697,356

[45] Date of Patent: Dec. 16, 1997

[54] ARROW HOLDER

[76] Inventor: David F. Chappell, 1264 N. 150 West, American Fork, Utah 84003

[21] Appl. No.: 735,026

[22] Filed: Oct. 22, 1996

[51] Int. Cl.[6] ..... F41B 5/22

[52] U.S. Cl. ..... 124/44.5

[58] Field of Search ..... 124/23.1, 24.1, 124/44.5, 86

[56] References Cited

U.S. PATENT DOCUMENTS

| | | | |
|---|---|---|---|
| 2,691,974 | 10/1954 | Nelson | 124/44.5 |
| 2,777,435 | 1/1957 | Brooks | 124/44.5 X |
| 3,499,414 | 3/1970 | Frydenlund | 124/44.5 X |
| 3,504,659 | 4/1970 | Babington | 124/44.5 X |
| 4,318,390 | 3/1982 | Trotter | 124/44.5 |
| 4,577,612 | 3/1986 | Zell | 124/44.5 |
| 4,685,439 | 8/1987 | Cosentino | 124/44.5 |
| 5,415,154 | 5/1995 | Angeloni | 124/44.5 |

OTHER PUBLICATIONS

Cabela's Archery, 1996 catalog, p. 30.

*Primary Examiner*—John A. Ricci
*Attorney, Agent, or Firm*—Craig S. Barrus

[57] ABSTRACT

An arrow holder which has a trigger and a retainer is disclosed. The arrow holder holds the arrow against the bow, whether the bow has an overdraw or not, until a fraction of a second before the arrow is released. Pressing the finger pull causes the retainer to rotate away from the arrow just before the drawn arrow is released. The retainer is able to rotate fully out of the way of the arrow shaft and fletching, so that the trajectory is not affected.

6 Claims, 3 Drawing Sheets

ARROW HOLDER

I. BACKGROUND

Hunting with a bow and arrow represents one of the greatest challenges to avid hunters throughout the world. The usual and customary method of drawing an arrow back includes looping the finger over the arrow to lock the arrow against the bow. Then, just before the arrow is released, the finger is withdrawn.

There are a couple of problems inherent in this method. First, there is a trend among archers to use arrows which are shorter, which means they are lighter. This lighter weight improves the accuracy by allowing a flatter trajectory. But with the shorter arrows comes the increased danger that the arrow might slip just as it is released, which would drive the arrowhead through the hand of the archer.

A second problem is that the archer must always be prepared to launch an arrow when he or she encounters game. In order to be ready, the hunter must always have his forefinger wrapped around the arrow to hold it against the bow arrow rest. The forefinger can quickly become fatigued. Worse, the finger might slip which would allow the arrow to slip and hit the bow, which would make a noise loud enough to startle game and result in a lost opportunity for that particular game. Or, the arrow could slip off the arrow rest at full draw, causing the hunter to try to push it back with his finger which may result in a severe cut on the finger by the arrowhead.

The present invention solves both problems. The arrow holder places a force against the arrow to lock it against the bow until game is sighted. The arrow can be drawn back, even if it is a shorter arrow, and still be retained by the arrow holder. Just a fraction of a second before the arrow is released, the arrow holder is activated to swing the arrow holder out of the way of the arrow, so that the arrow can be launched without a further impediment. The nature of the invention is such that the fletching of the arrow does not engage the arrow holder, so the flight of the arrow is unaffected.

Furthermore, because there is a mechanical device holding the arrow at all times during the hunt, there is little chance that the forefinger will become fatigued. This results in a more enjoyable hunt, as well as ready at all times to release an arrow when game is encountered. And since the finger is no longer necessary to lock the arrow against the bow arrow rest, there is little chance that an arrow will inadvertently hit against the bow which would make a noise to startle game.

There are four other advantages which deserve mention. The first major advantage is that the present arrow holder is easy to install and use. No special tools or skills are required. The second major advantage is that the arrow holder is easily manufactured, which means a greater potential market because it will be within the budget of most, if not all, archers. The third advantage is that this device will easily fit all modern bows and overdraws, and could be easily adapted to either recurve or long bows. And fourth, the inherent safety factors of this device would appeal to beginner and expert archers alike.

II. SUMMARY

The present invention has a finger pull which is similar to a trigger on a gun. As the trigger is pulled, the retainer is quickly moved away from the arrow just a fraction of a second before the arrow is released. A spring can be used to provide the force for rotating the retainer quickly away from the arrow. A plate holding the retainer and the trigger arm has holes which can be used to mount the plate to the bow on the opposite side of the arrow rest. As the trigger arm is pulled downward around the pivot, the first notch becomes disengaged from the second notch of the shaft, which allows the shaft to rotate. This rotation of the shaft moves the retainer out of the way of the arrow as the arrow is released. When another arrow is notched, or placed in the bow, the retainer can be rotated to engage the arrow. When the second notch becomes aligned with the first notch, a spring pulls the finger pull upwards which locks the shaft to hold the retainer until the next arrow is released.

There are several adjustments which can be made on the present invention to accommodate practically any bow. The retainer is held to the shaft by a screw. Loosening the screw allows the retainer to be moved in and out so that exactly placement over the arrow can be obtained. Tightening the screw sets the position of the retainer. Different lengths of shafts can be used to account for different overdraws, or if no overdraw is used, the shaft can be selected to accommodate the bow. It is also apparent that several holes could be placed in the shaft to allow for lateral adjustment of the retainer along the shaft without the necessary of interchanging shafts.

Another adjustment that is easily made is the force which is required to pull the trigger arm. If a light touch were desired, a spring with a light retaining force could be used. If a heavier touch were desired, then a heavier spring could be added.

A similar alternative and simpler arrow holder is also disclosed. As the trigger arm moves downward about the pivot, the retainer moves upward and releases the arrow. Stops on the plate prevent the trigger arm and the retainer from moving too far downward, in the case of the trigger arm, or too far upward, in the case of the retainer.

III. BRIEF DESCRIPTION OF THE DRAWINGS

These and other features, aspects and advantages of the present invention will become better understood with regard to the following description, appended claims, and accompanying drawings where:

IV. DETAILED DESCRIPTION OF THE DRAWINGS

Figure 1:
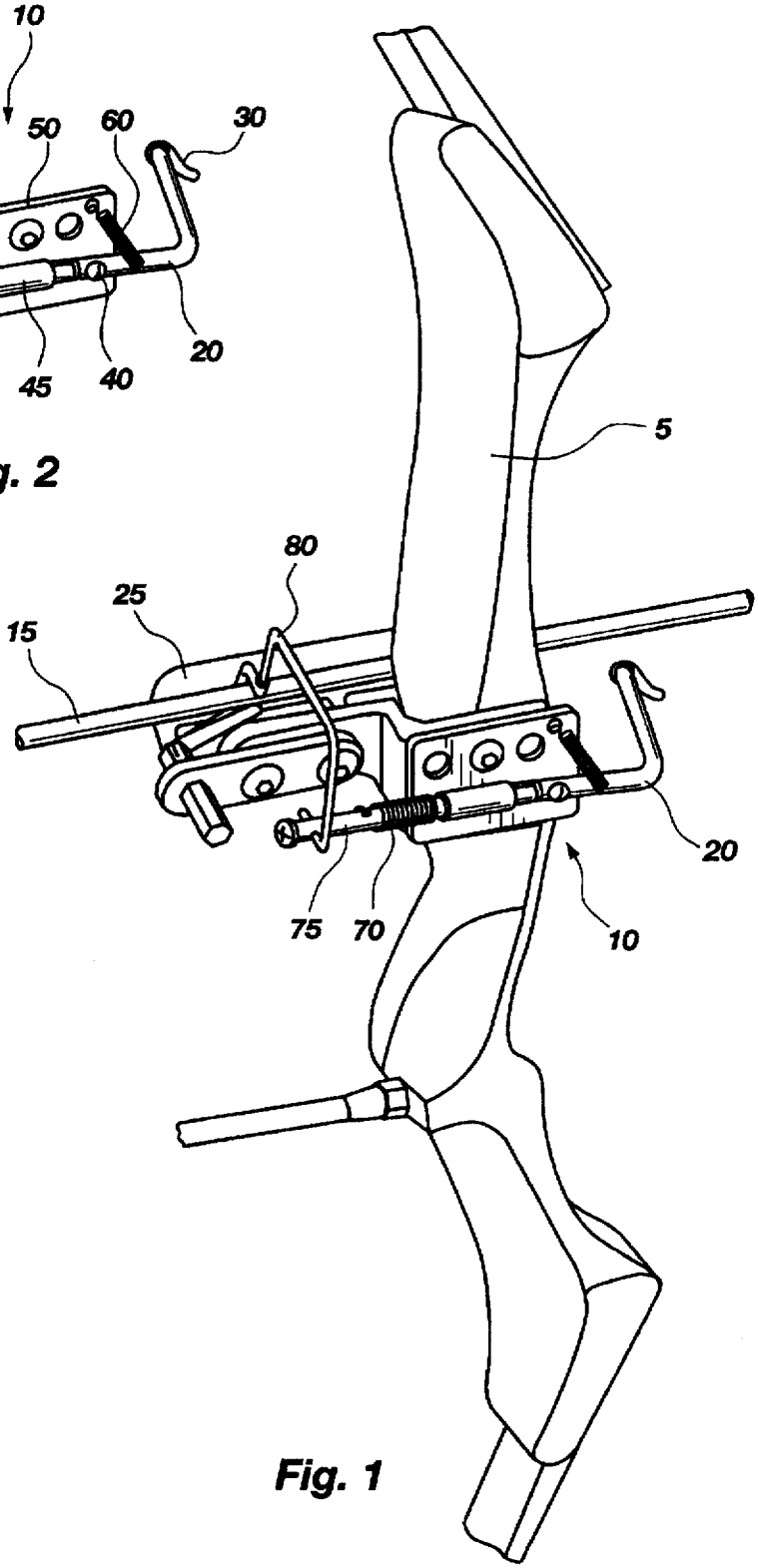
FIG 1 is a perspective view of the arrow holder mounted on a bow.
Figure 3:
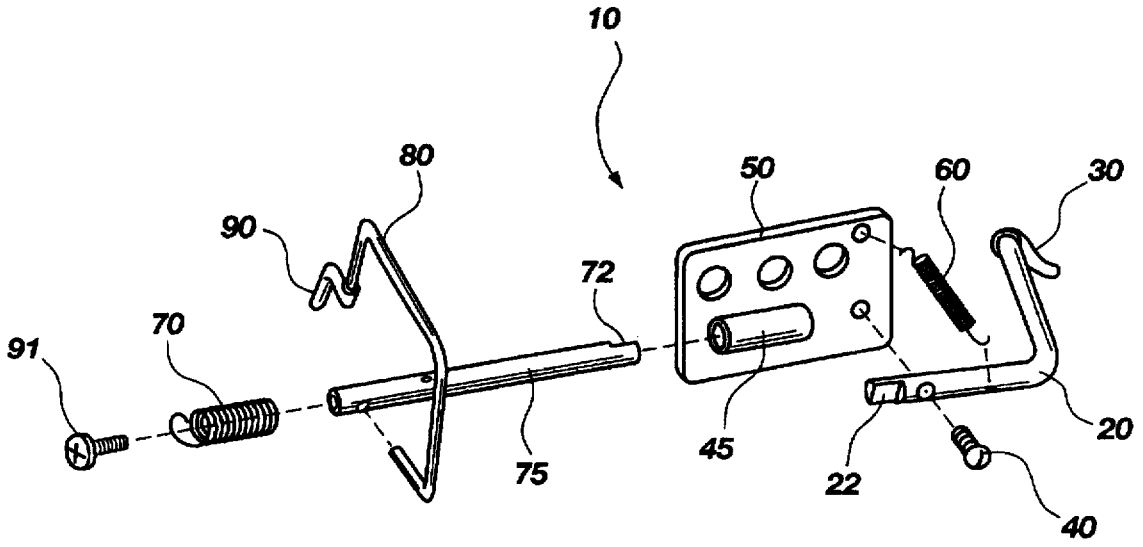
FIG 3 is a perspective view of the assembly of the arrow holder.

FIG. 1 is a perspective view of the arrow holder (10) mounted to the bow (5). This drawing also shows the overdraw (25) attached to the bow (5) to hold the arrow (15).

Figure 2:
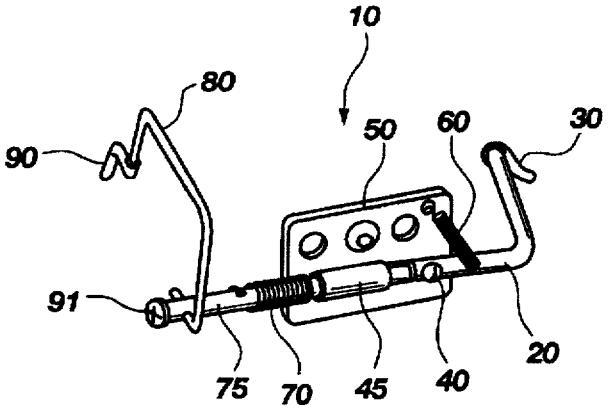
FIG 2 is a perspective view of the arrow holder.

FIG. 2 is a perspective view of the arrow holder (10). The trigger arm (20) is attached to a plate (50) by a pivot (40). As the finger pull (30) is depressed, the trigger arm (20) is moved downward about the pivot (40). A first spring (60) applies tension to the trigger arm (20) to keep the trigger arm (20) in a latched condition until the arrow (15) is released.

After the arrow (15) is released, the first spring (60) returns the trigger arm (20) to its starting position. A sleeve (45) is mounted to the plate (50) to allow the shaft (75) to rotate. A second spring (70) placed on the shaft (75) provides the force to rotate the shaft (75). A retainer (80) is attached to the shaft (75), and a screw (91) in the end of the shaft (75) allows adjustment of the retainer (80) so that the retainer (80) can be exactly placed to hold the arrow (15) against the bow (5). As the trigger pull (30) is depressed, the trigger arm (20) moves downward about the pivot (40). This allows the first notch (22) on the trigger arm (20) to move upward and disengage from the second notch (72) on the shaft (75). When the second notch (72) becomes disengaged, the shaft (75) rotates. Rotation of the shaft (75) also rotates the retainer (80) up and out of the way of the arrow (15). Rotation of the shaft (75) within the sleeve (45) is accomplished by a second spring (70). A silencer (90) can be placed on the retainer (80) where the retainer (80) engages the arrow (15). This silencer (90) can be made of plastic or other resilient material to eliminate or minimize the noise which would occur if the retainer (80) were in contact with the arrow (15) as the arrow (15) was drawn back. The shaft (75) can be held within the sleeve (45) if the second spring (70) is attached to the shaft (75) and the plate (50) or the sleeve (45).

Figure 4:
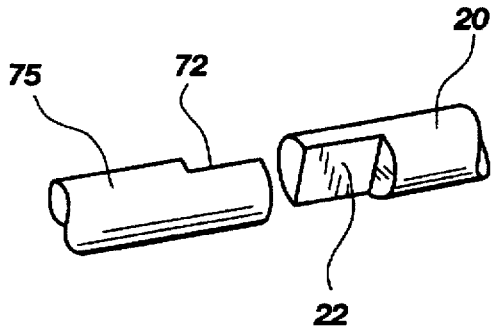
FIG 4 is a sectional view of the engagement of the trigger arm and the shaft.

FIG. 4 is a perspective view showing the details of how the trigger arm (20) engages and disengages the shaft (75). The first notch (22) on the trigger arm (20) has a flat surface. The second notch (72) on the shaft (75) also has a flat which engages the first notch (22). As the trigger arm (20) moves the first notch (22) upwards, the first notch becomes disengaged from the second notch (72). This allows the shaft (75) to rotate.

Figure 5:
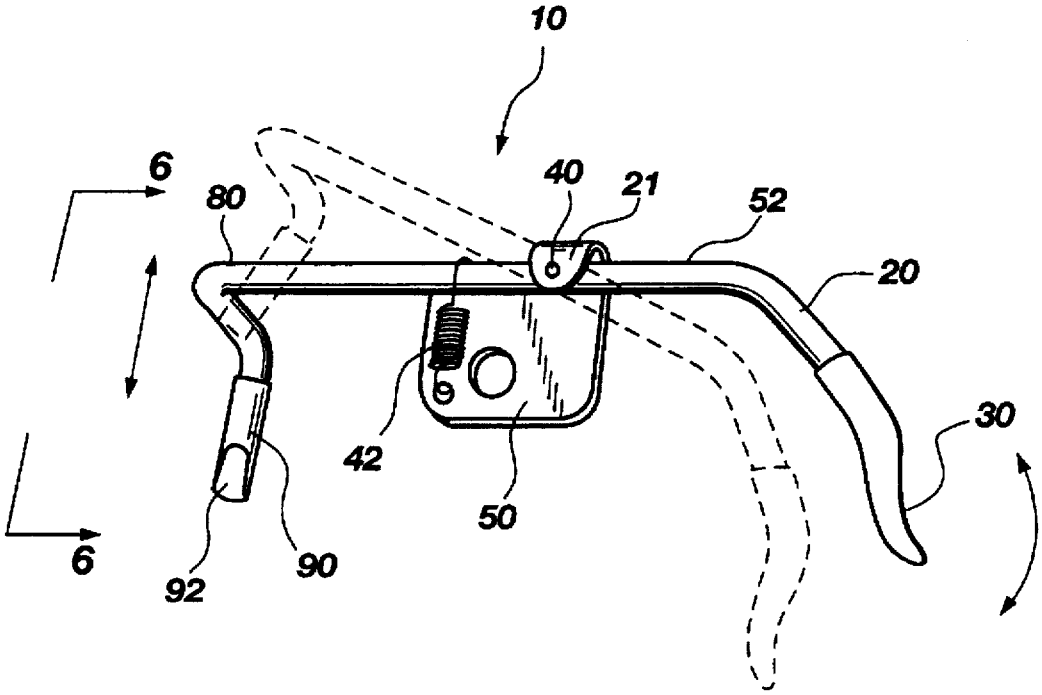
FIG 5 is a perspective view of a similar but an alternative arrow holder.

FIG. 5 is a perspective of a similar but an alternative arrow holder (10). The arrow holder (10) has a longitudinal member (52) which can be one piece. On one end is the finger pull (30) which is part of the trigger arm (20). On the other end of the longitudinal member (52) is the retainer (80) which holds the arrow (15). The longitudinal member (52) is attached to the plate (50) by a pivot (40). As the finger pull (30) is depressed, the longitudinal member (52) pivots about the pivot (40), which raises the retainer (80). A silencer (80) can also be placed over the retainer (80) to minimize the noise as the arrow (15) is drawn while the arrow holder (10) is holding the arrow (15). The retainer (80) has a third notch (92) to hold the arrow (15).

Figure 6:
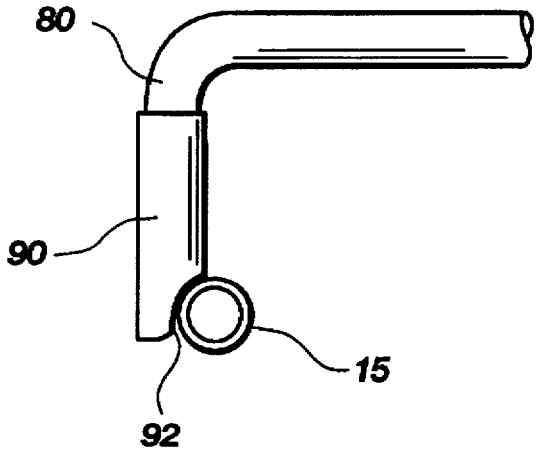
FIG 6 is an end view of the alternative arrow holder.

FIG. 6 is a sectional view showing the end of the retainer (80) and the third notch (92) to engage the arrow (15). Also shown is the silencer (90) on the retainer (80) to minimize noise.

The present invention, may be carried out in other specific ways other than those set forth above without departing from the scope of the invention. The above embodiments are, therefore, to be considered as illustrative, and the applicant intends only to be limited by the claims appended hereto.

What is claimed is:

1. An arrow holder which may be attached to an archery bow which comprises:

a trigger arm;

a plate to which the trigger arm is pivotally connected;

a sleeve which is attached to the plate;

a shaft which is inserted into the sleeve to releasably engage the trigger arm; and a retainer connected to the shaft which rotates away from the arrow when the trigger arm releases the shaft.

2. An arrow holder as in claim 1 wherein the shaft has a spring to rotate the shaft within the sleeve.

3. An arrow holder as in claim 2 wherein the trigger arm has a spring to provide tension to the trigger arm to prevent movement until desired.

4. An arrow holder as in claim 3 wherein the retainer has a silencer.

5. An arrow holder as in claim 4 wherein the silencer is a resilient material to absorb sound.

6. An arrow holder as in claim 3 wherein the retainer is adjustable to exactly engage the arrow.

* * * * *